United States Patent [19]

Locke et al.

[11] 4,248,349

[45] Feb. 3, 1981

[54] TRAY FOR AMPOULES OR THE LIKE

[75] Inventors: Merrel J. Locke, Linwood; Arthur W. Penman, Toms River, both of N.J.

[73] Assignee: Dougherty Brothers Company, Buena, N.J.

[21] Appl. No.: 967,467

[22] Filed: Dec. 7, 1978

[51] Int. Cl.³ ..... B65D 1/34; B65D 6/04

[52] U.S. Cl. ..... 206/538; 206/561; 220/7

[58] Field of Search ..... 206/558, 560, 561, 557, 206/534.1, 534.2, 261, 276, 538, 539, 533, 327, 332, 334, 419, 420, 443; 220/339, 6, 7

[56] References Cited

U.S. PATENT DOCUMENTS

| | | | |
|---|---|---|---|
| 2,711,819 | 6/1955 | Vanderlugt, Jr. | 206/561 X |
| 2,755,982 | 7/1956 | Vanderlugt, Jr. | 206/334 X |
| 2,767,532 | 10/1956 | Bossl . | |
| 3,270,877 | 9/1966 | Hecker . | |
| 3,596,822 | 8/1971 | Danforth | 220/339 X |
| 3,606,006 | 9/1971 | Raybois | 206/561 X |
| 3,607,440 | 9/1971 | Fred | 206/334 X |
| 3,675,808 | 7/1972 | Brink | 220/7 |
| 3,707,227 | 12/1972 | Britt | 220/339 X |
| 3,712,695 | 1/1973 | Kaye | 206/558 X |
| 3,744,623 | 7/1973 | Woofter | 220/6 |
| 3,750,890 | 8/1973 | Smith et al. | 220/23.4 |
| 4,129,211 | 12/1978 | Clement et al. | 206/561 X |

FOREIGN PATENT DOCUMENTS

| | | | |
|---|---|---|---|
| 448880 | 12/1967 | Switzerland | 220/339 |

*Primary Examiner*—Joseph Man-Fu Moy

*Attorney, Agent, or Firm*—Seidel, Gonda, Goldhammer & Panitch

[57] ABSTRACT

A one piece polymeric plastic tray has a plurality of U-shaped troughs. At least one upright end wall is integral in one piece with and pivotably connected to said partitions at the bight portion of the troughs. Said end wall and at least some of said partitions having cooperating means to facilitate latching said end wall in an upright disposition generally perpendicular to said partitions.

7 Claims, 12 Drawing Figures

FIG. 1
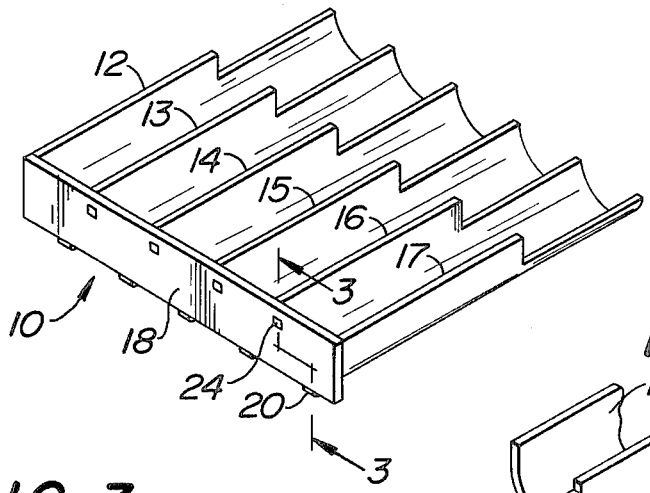
FIG. 2
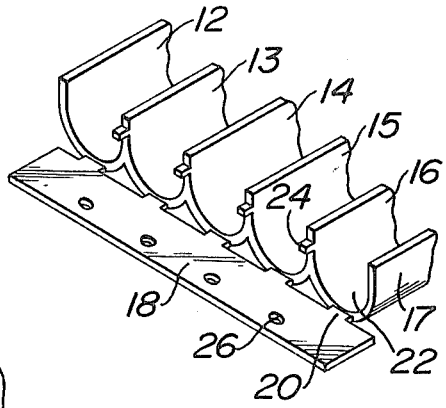
FIG. 3
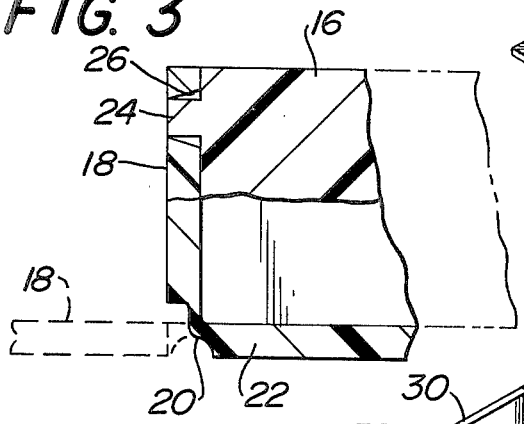
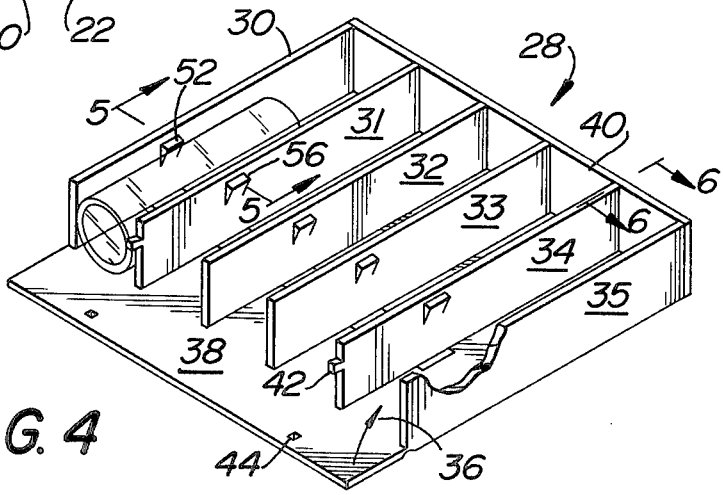
FIG. 4

FIG. 9
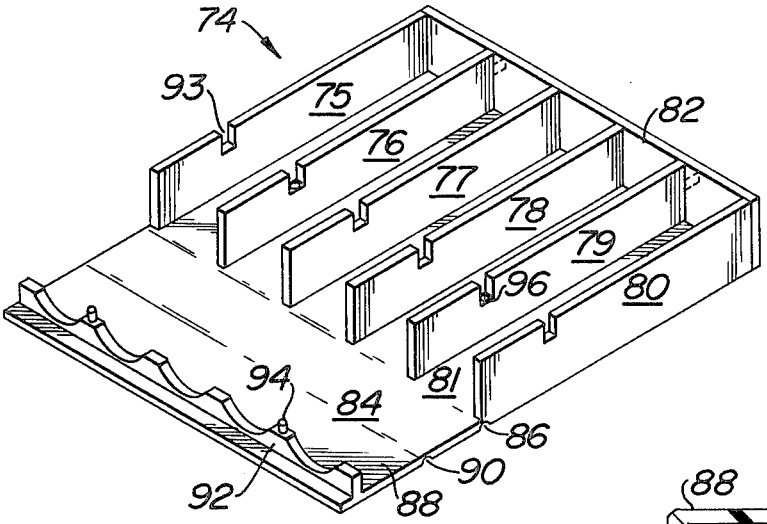
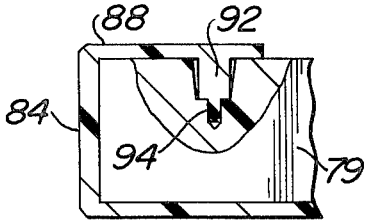
FIG. 12
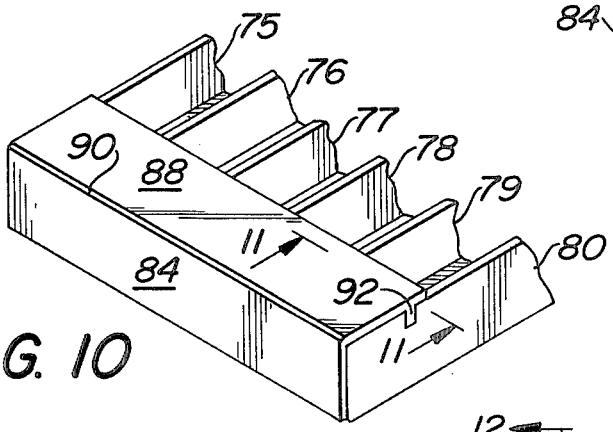
FIG. 10
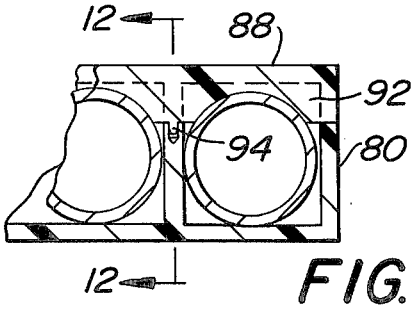
FIG. 11

TRAY FOR AMPOULES OR THE LIKE

BACKGROUND

Trays of the general type involved herein are known from U.S. Pat. Nos. 2,767,532 and 3,270,877. In said patents, the trays are made of paper. Experience with such paper trays has created substantial problems in connection with packaging of ampoules or the like. The paper trays are extremely sensitive to moisture in the atmosphere. When the atmosphere is humid, the trays have little or no strength and frequently cause jam ups in packaging equipment. The present invention is directed to a tray which eliminates such problems and has other desirable features.

SUMMARY OF THE INVENTION

The present invention is directed to an article of manufacture which is preferably in the form of a one piece polymeric plastic tray having a plurality of upright partitions. Each partition cooperates with the next adjacent partition to define generally parallel U-shaped troughs. At least one upright wall integral in one piece with and pivotably connected to said partitions at the bight portion thereof is provided. The end wall and at least some of said partitions have cooperating means to facilitate latching the end walls in an upright disposition and generally perpendicular to the partitions.

In other embodiments of the present invention, there are provided additional features which facilitate frictional contact between the partitions and the ampoule or the like so as to minimize movement of the ampoule or the like in a lengthwise direction along the troughs.

It is an object of the present invention to provide a novel packaging tray made from a polymeric plastic material which will minimize problems in connection with varying humidity conditions while at the same time being more rigid than the prior art, easier to handle than the prior art, and having other features as will be made clear hereinafter.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a first embodiment of the present invention.

FIG. 2 is a partial perspective view of the embodiment shown in FIG. 1 but with the end wall in a horizontal disposition.

FIG. 3 is a sectional view taken along the line 3—3 in FIG. 1 but on an enlarged scale.

FIG. 4 is a perspective view of another embodiment of the present invention.

FIG. 9 is a perspective view in accordance with another embodiment of the present invention wherein one end wall is in an open disposition.

FIG. 10 is a partial perspective view of the embodiment shown in FIG. 9 but with said one end wall in a closed disposition.

FIG. 11 is a sectional view taken along the line 11—11 in FIG. 10.

FIG. 12 is a sectional view taken along the line 12—12 in FIG. 11.

Figure 5:
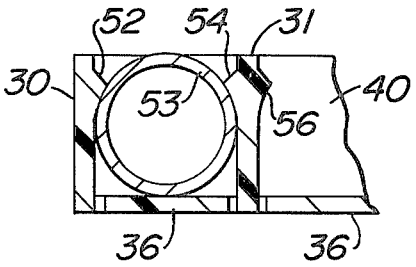
FIG. 5 is a sectional view taken along the line 5—5 in FIG. 4.

Referring to the drawings in detail, wherein like numerals indicate like elements, there is shown in FIGS. 1-3, a first embodiment of the present invention wherein the tray is designated generally as 10. The tray 10 is injection molded in one piece and includes a plurality of partitions 12–17 inclusive. The partitions 12–17 are upright and each partition cooperates with the next adjacent partition to define a parallel generally U-shaped trough.

An upright end wall 18 is integral in one piece and pivotably connected to the partitions at the bight portions of the troughs by way of hinges 20. Each hinge 20 is thinner than the material of the end wall 18 and the partitions 12–17. Each of the end wall 18, partitions 12–17, and the bight portions 22 are of the same thickness.

The end wall 18 and some of the partitions 12–17 have cooperating structures to facilitate latching the end wall 18 in an upright disposition generally perpendicular to said partitions as shown in FIG. 1. Such cooperating structure includes a projection 24 on one or more of the partitions such as partition 16 and a cooperating hole 26 in the end wall 18. The hole 26 is tapered so that its transverse dimensions adjacent the partition 16 is greater than the transverse dimensions of the projection 20 to thereby facilitate the ease in which latching may occur. The frictional engagement between projection 24 and hole 26 is sufficient to retain the end wall 18 in an upright disposition.

The partitions 12–17 are of non-uniform height. Thus, each partition is of two different heights, with the heights of the partitions being uniform at each end thereof. The smaller height of the partitions facilitates the ease in which the ampoules or the like may be inserted in the troughs. While five such troughs are illustrated in FIGS. 1 and 2, a greater or lesser number of troughs may be provided.

Figure 6:
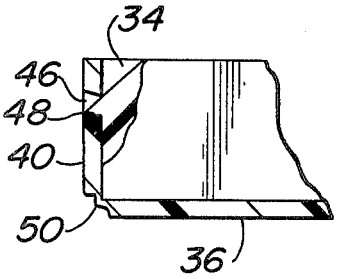
FIG. 6 is a sectional view taken along the line 6—6 in FIG. 4.

In FIGS. 4–6 inclusive, there is illustrated another embodiment of the present invention designated generally as 28. The tray 28 includes partitions 30–35 inclusive with each partition being connected to the next adjacent partition by a bight portion 36 to thereby define parallel generally U-shaped troughs. The tray 28 is provided with end walls at each end thereof. The end walls are designated 38, 40. One or more of the partitions such as partition 34 has a projection 42 which frictionally cooperates with a mating hole 44 in the end wall 38 in the manner described above whereby the end wall 38 may be latched in an upright disposition. End wall 38 is connected to the bight portion 36 by means of a reduced thickness hinge as described above.

The end wall 40 is provided with one or more holes 48 each adapted to receive a projection 46 on a partition such as partition 34. See FIG. 6. The projections 46 have a friction fit with their mating hole 48 in the same manner as described above. End wall 40 is connected to the bight portion 36 by a reduced thickness hinge 50.

Each of the partitions 30–35 inclusive has a projection on its inner surface for centering and frictionally engaging an ampoule or the like. See FIG. 5. Partition 30 has a projection 52 which cooperates with projection 54 on partition 31 to frictionally contact an ampoule 53. The partition 31 on its other side has another projection 56 which is adapted to cooperate with a mating similar projection on the juxtaposed surface of partition 32.

Figure 7:
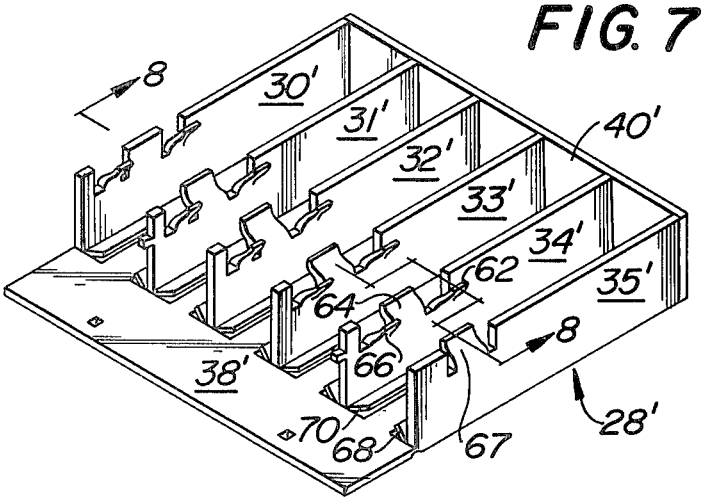
FIG. 7 is a perspective view of another embodiment of the present invention.
Figure 8:
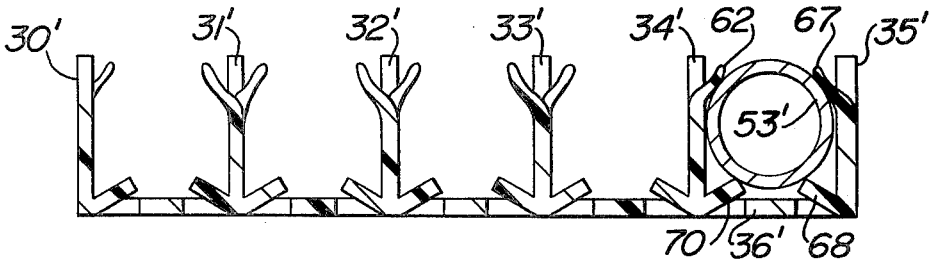
FIG. 8 is a sectional view taken along the line 8—8 in FIG. 7.

In FIGS. 7 and 8, there is illustrated another embodiment of the present invention designated generally as 28'. The tray 28' is identical with the tray 28 except as will be made clear hereinafter. Accordingly, corresponding elements are provided with corresponding primed numerals.

The tray 28', in place of the projections 52, 54 and 56, includes equivalent structure which is molded into the partitions. Thus, partition 34' has tongues 62, 64 and 66 which alternatively extend in opposite directions to either side of the partition. Partitions 31'-33' are similarly constructed. The end partitions such as partition 35' have only a single tongue 67. Tongues 62, 66 and 67 cooperate to frictionally contact the ampoule 53'.

Beginning adjacent the bottom of the partitions, the bight portion 36' is provided with upstanding integral slats 68 and 70 which extend upwardly at an acute angle of about 45° for line contact with the ampoule 53'. Openings are provided in the bight portion 36' and opposite to and of a size corresponding to the slats 68, 70. Each of the troughs of tray 28' have similar slats corresponding to slats 68 and 70. The slats 68 and 70 are sufficiently flexible so that they may pivot downwardly whereby the troughs of tray 28' can accommodate different size ampoules.

In FIGS. 9-12, there is illustrated another embodiment of the present invention wherein the tray is designated generally as 74. The tray 74 has upright partitions 75-80 inclusive which cooperate with one another and a bight portion 81 to define parallel U-shaped troughs. Tray 84 has an end wall releasably connected to one end of the troughs in the same manner as described above in connection with end wall 40. At the opposite end, there is provided an end wall 84 connected to the bight portions 81 by way of a hinge 86 in the same manner as end wall 44. Wall 84 has an extension 88 which is of similar dimensions and connected thereto by way of hinge 40.

The extension 88 has an integral bridge member 90. Each of the partitions 75-80 has a notch 93 of sufficient dimensions to receive the bridge member 92. The bridge member 92 has one or more projections 94. Each of the projections 94 is adapted to be received in a mating hole 96 at the bottom of one of the notches 93 such as the notch in partition 79. See FIGS. 11 and 12. In the disposition shown in FIG. 10, the end wall extension 88 overlies the top edge of the partitions 75-80.

Each of the trays described above is preferably made from a polymeric plastic material capable of being injection molded such as polypropylene. A wide variety of other polymeric plastics may be used such as polyethylene, polyvinylchloride, polyurethane, etc. By being injection molded from plastic, the trays are stiffer than paper trays, are not susceptible to loss of strength due to high humidity, and therefore can be used with high speed packaging equipment without creating jam ups. At the same time, the structural interrelationship of the components of the trays facilitates manufacture of the trays in a inexpensive, reliable manner by use of high speed injection molding equipment.

The present invention may be embodied in other specific forms without departing from the spirit or essential attributes thereof and, accordingly, reference should be made to the appended claims, rather than to the foregoing specification, as indicating the scope of the invention.

I claim:

1. An article of manufacture comprising an open top tray having a plurality of upright partitions, two of said partitions being the side walls of the tray, each partition cooperating with the next adjacent partition to define parallel generally U-shaped troughs, upright end walls pivotably connected to opposite ends of said partitions at the trough bight portion by a reduced thickness hinge whereby said end walls may pivot from a horizontal position to an upright disposition, the height of said end walls being not greater than the height of the adjacent end of said partitions, said end walls and at least some of said partitions having cooperating means including a discrete projection on at least two of said partitions disposed between said side walls and at the end thereof, said means including a mating hole for each projection in one of said end walls to facilitate locking said end walls in an upright disposition generally perpendicular to said partitions, said partitions and walls being integral in one piece with said hinges and being made from a polymeric plastic, and adjacent partitions having an integral projection extending into the trough therebetween for securing an ampoule in the trough.

2. An article in accordance with claim 1 wherein the partitions are shorter in height at one end than at the other end.

3. An article in accordance with claim 1 wherein at least some of said partitions have projections extending to opposite sides thereof so as to increase the thickness of the partitions at such location to facilitate frictional contact with an article to be packaged in the troughs.

4. An article in accordance with claim 1 wherein each of the partitions has at least one tongue angularly disposed out of the plane of the partition and extending towards the next adjacent partition.

5. An article in accordance with claim 1 wherein said troughs include a movable member so as to facilitate reception of articles of different diameters within the troughs.

6. An article in accordance with claim 1 wherein the holes are tapered in a direction away from the ends of the partitions.

7. An article of manufacture comprising a one piece polymeric plastic tray having a plurality of upright partitions, each partition cooperating with the next adjacent partition to define generally parallel U-shaped troughs, at least one upright end wall integral in one piece with and pivotably connected to said partitions at the bight portion thereof, said end wall having first and second panels pivotably connected together, said end wall first panel corresponding generally to the height of said partitions, said second panel being pivotable to a position for overlying the upper surface of said partitions, said second panel having a plurality of concave surfaces with the number of said surfaces corresponding generally to the number of said partitions whereby each such surface may cooperate with a round object between adjacent partitions for holding the same downwardly, said second panel having a plurality of pins, some of said partitions having a hole, each pin being adapted to enter one of said holes to frictionly lock the end wall in place.

* * * * *